US006397605B1

(12) United States Patent
Pundak

(10) Patent No.: US 6,397,605 B1
(45) Date of Patent: Jun. 4, 2002

(54) STIRLING COOLER

(75) Inventor: Nachman Pundak, Kibbutz Ein Harod Yichud (IL)

(73) Assignee: Ricor Ltd., Yichud (IL)

( * ) Notice: Subject to any disclaimer, the term of this patent is extended or adjusted under 35 U.S.C. 154(b) by 0 days.

(21) Appl. No.: 09/516,763

(22) Filed: Mar. 1, 2000

(30) Foreign Application Priority Data

Mar. 3, 1999 (IL) ..... 128808

(51) Int. Cl.[7] ..... F25B 9/00
(52) U.S. Cl. ..... 62/6
(58) Field of Search ..... 62/6, 55.5, 277

(56) References Cited

U.S. PATENT DOCUMENTS 5,361,588 A * 11/1994 Asami et al. ..... 62/6
5,502,968 A * 4/1996 Beale ..... 62/6
5,615,556 A * 4/1997 Honda et al. ..... 62/6
5,813,235 A * 9/1998 Peterson ..... 62/6

* cited by examiner

*Primary Examiner*—William C. Doerrler
(74) *Attorney, Agent, or Firm*—Eitan, Pearl, Latzer & Cohen-Zedek

(57) ABSTRACT

A Stirling cooler made up of a first cylinder and a second cylinder. The first cylinder includes a driven piston for maintaining reciprocal gas displacement by compressing a gas in a closed cycle. The second cylinder is in fluid communication with the, first cylinder through a conduit which has a heat rejector in thermal contact with it, for rejecting heat from the second conduit. The second cylinder is made up of a displacer, an expansion chamber and a regenerator. The displacer normally oscillates within the second cylinder in response to gas pulses received through the conduit. The expansion chamber is at a first extremity of the second cylinder. The expansion chamber is cooled by the gas at the first extremity of the second cylinder. The piston is driven by means which drive the piston at a speed required for normal cooling generation resulting in displacer oscillation being less than 90 degrees out of phase with the piston. The piston is also driven by means for selectively driving the piston at a speed above the resonant frequency of the displacer to cause the displacer oscillation to be out of phase with the piston by more than 90 degrees for the generation of heat in the expansion chamber.

4 Claims, 2 Drawing Sheets

STIRLING COOLER

FIELD OF THE INVENTION

The present invention relates to an improved cryogenic cooler, and to a process chamber using such cooler.

More particularly, the invention provides a method of defrosting the cold head and the cooled panel of a Stirling-cycle cooler without requiring electric heaters for this purpose.

BACKGROUND AND SUMMARY OF THE INVENTION

Cryogenic coolers are used in industrial, medical and research fields for various purposes such as gas liquefaction, sputtering processes, cooling superconducting magnets, cooling infra-red sensors, during the manufacture of semiconductors, refrigerated storage of biological materials, X-ray detectors, and cooling radio-frequency antenna components.

The standard Stirling-cycle refrigerator consists of a piston for isothermal compression of the working fluid, usually helium, and a displacer, which can operate in the same cylinder with the piston, or it can operate in its own cylinder.

The displacer and piston are connected, either mechanically to the same driven shaft or merely by a gas conduit. When operating, the cylinder and displacer are usually displaced in phase by 90 degrees. The displacer pushes compressed gas isochorically from the warm region where it was compressed through the regenerator into the cold region where the compressed gas is expanded isothermally doing work on the displacer and producing irrgeration. The displacer returns the gas after expansion through the regenerator for re-compression by the piston.

The regenerator is cooled by gas having completed its expansion cycle and so is able to cool incoming gases from the next cycle before they enter the expander chamber. All Stirling machines use a regenerator to improve efficiency, although this item is not needed for gaining an understanding of the Stirling cycle.

Recent U.S. patents disclose suggested improvements to Stirling refrigerators.

In U.S. Pat. No. 5,502,968 Beale discloses a free piston Stirling machine having a variable power transmitting linkage connecting the displacer and piston. This adjustment is used in a cooler to control the thermal pumping rate.

Benschop in U.S. Pat. No. 5,590,534 proposes to add heat flow reduction means between the compressor and the cooling element which is claimed to eliminate the need for heat sinking on the warm side:

The NASA Ames Research Center reported a recent development in Stirling coolers concerning a Pulse Tube cooler at the 8th International Cryocooler Conference, 1994. This cooler is similar to the standard Stirling cooler, but there is no displacer. Instead, the working gas oscillates back and forth in the pulse tube, working at frequencies well below resonance. Heating results at the closed end of the tube and cooling at the end adjacent to the regenerator. Efficiency improvements have been made by adding a reservoir at the hot end of the pulse tube, and adding by-pass tubes between the regenerator and the pulse tube. The attractions of the pulse tube include few moving parts, and improved durability. The Pulse Tube cooler requires yet further efficiency improvement before becoming competitive with the standard Stirling or other known coolers such as the Gifford-McMahon type.

It is usually advantageous that cryogenic processes be carried out in a vacuum. One reason is to eliminate air convection and its resultant inward heat leakage.

Other reasons are connected with the particular process being carried out.

One of the problems encountered with cryogenic refrigerators is frosting over of the cold end, and eventually also of the cryopanel with which it is in thermal contact. During normal operation gas remnants freeze and solidify on the cryopanel, reduce its heat transfer coefficient to cause a deterioration in performance, and de-frosting needs to be carried out—a process familiar to owners of ordinary household refrigerators not provided with automatic defrosting. In certain processes this requires that the process be shut down, while electric heaters are operated to fast defrost both the cold end and the cryopanel. The use of electric heaters near cryogenic equipment can cause safety problems, and complicates the equipment layout making maintenance more difficult. Alternatively slow defrosting can be carried out simply by shutting down the cooler, but much valuable processing time is lost. Before resuming work on the process being carried out, the released gases need to be removed, for which purpose a turbomolecular pump is typically employed to reduce gas pressure to under $10^{-9}$ torr, depending on the process requirements.

It is therefore one of the objects of the present invention to obviate the disadvantages of prior art Stirling coolers and to provide a device which can be fast defrosted without the need for electric heaters.

It is a further object of the present invention to provide a cryogenic vacuum process chamber where the cryopanel can also be fast defrosted without the need for electric heaters.

The present invention achieves the above objects by providing a Stirling cooler comprising a driven piston in a first cylinder for maintaining reciprocal gas displacement by compressing a gas in a closed cycle, said cylinder being in fluid communication through a conduit with a second cylinder containing a free displacer, said displacer normally oscillating inside said second cylinder in response to gas pulses received through said conduit. The second cylinder further contains a regenerator, and an expansion chamber being cooled by said gas at a first extremity.

A pneumatic spring volume on which work is performed is linked to the displacer at a second extremity. Heat rejection means are in thermal contact with the conduit.

Means for driving the piston at a speed required for normal cooling generation result in displacer oscillation being less than 90 degrees out of phase with the piston.

Means are provided for selectively driving the piston at a speed above the resonant frequency of the displacer to cause displacer oscillation to be out of phase with the piston by more than 90 degrees for the generation of heat in the expansion chamber.

In a preferred embodiment of the present invention the is provided a cooler wherein piston drive means comprise a variable speed electric motor.

In a most preferred embodiment of the present invention there is provided a cryogenic vacuum process chamber cooled by a panel in thermal contact with a cooler. The panel receives heat from said cooler for defrosting of said panel when said cooler is selectively operated at a speed above the resonant frequency.

Yet further embodiments of the invention will be described hereinafter.

In U.S. Pat. No. 5,813,235 Peterson describes and claims a resonantly coupled alpha Stirling cooler which has hot and cold variable-volume chambers, a regenerator, and a driver for maintaining reciprocating gas displacement between the chambers. Only the hot side of the cooler is driven. The cold side responds passively by resonant coupling. The phase difference between volume oscillations in the hot and cold variable-volume chambers is altered by adjusting the driving frequency.

From claim 10 it is clear that the aim of changing the drive frequency is to increase cooler efficiency. Such changes would likely be confined to minor adjustments of the phase difference between the oscillations of the volumes of the variable volume chambers.

In contradistinction thereto, the present invention provides for adjustment of the phase difference to exceed 90 degrees in order to generate heat in the cold end of the cooler. Such a large phase difference, and such use thereof, is not taught or suggested by Peterson in his disclosure.

It will thus be realized that the novel device of the present invention generates heat, when required, in the chamber, sometimes referred to as the cold end, normally used for gas expansion. This chamber has a variable volume due to displacer oscillation. Displacer oscillation has an undamped natural frequency which increases with an increase of the spring rate of the pneumatic spring and decreases with an increase in the mass of the displacer. When the piston is driven faster than this frequency, a gas pulse arrives in the expansion chamber already while the displacer is still moving towards the closed end of the chamber. Consequently, the gas, instead of being expanded as in normal operation for cooling, is now compressed by the displacer, so generating heat. Thereafter the gas is transferred back to the piston where it is expanded. Such expansion absorbs heat which is now obtained from the ambient via the same expanded surface device which in normal operation is used for rejecting heat to the ambient.

In this way the cold end of the cooler and items in thermal contact therewith can be temporarily heated to quickly remove solidified gases attached thereto. These gases are then removed by a suitable high vacuum pump. The process is analogous to removing accumulated water from a household refrigerator which has just been defrosted.

The elimination of electric heaters used on prior-art coolers for periodic fast defrosting brings advantages in reducing equipment complexity and cost, easing maintenance, and in improving safety.

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

DETAILED DESCRIPTION OF THE PRESENT INVENTION

Figure 1:
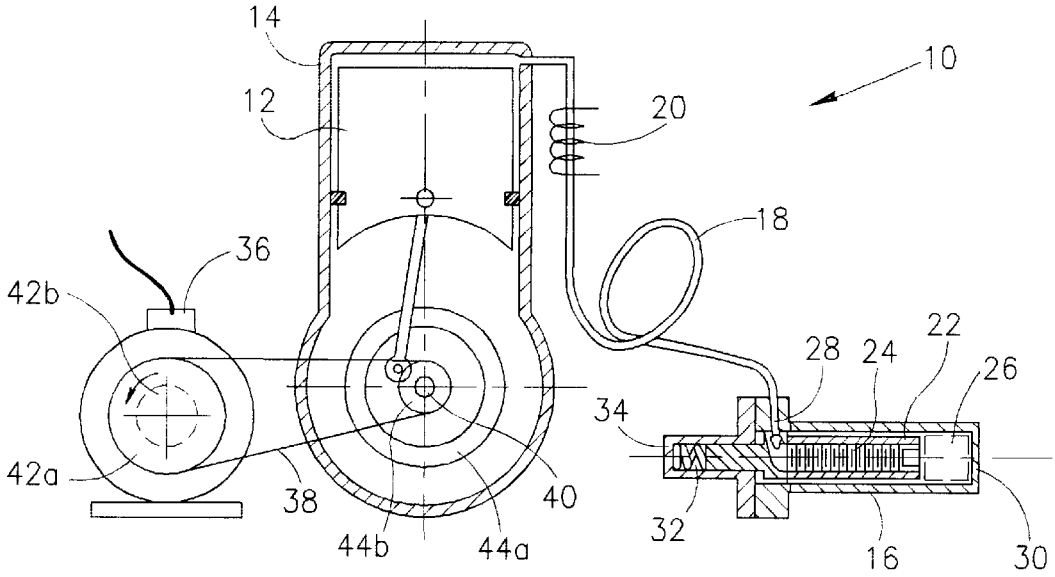
FIG. 1 is a diagrammatic view of a preferred embodiment of the cooler according to the invention.

There is seen in FIG. 1 a Stirling cooler 10 comprising a driven piston 12 operating in a first cylinder 14. The piston 12 maintains reciprocal gas displacement by compressing a gas, suitable helium, in a closed cycle.

The first cylinder 14 is in fluid communication with a second cylinder 16 through a conduit 18, comprising a single flexible transfer line. Heat rejection means 20 are in thermal contact with the conduit. The heat of compression is rejected to ambient by means of a heat exchanger, such as a gas-to-air finned unit disposed on the conduit 18 near the first cylinder 14.

The second cylinder 16 contains a free displacer 22, i.e., a displacer not mechanically connected to the piston 12. When in operation, the displacer 22 oscillates inside the second cylinder 16 in response to gas pulses received through the conduit 18.

The second cylinder 16 further contains a regenerator 24, which is a porous expanded-surface cylinder through which the gas passes alternately in both directions. Heat is transferred between the gas and the regenerator 24, the gas either giving or receiving heat, depending on whether the gas is hotter or colder than the regenerator 24. As in all Stirling machines, the regenerator 24 is used for improving efficiency.

An expansion chamber 26 is located at a first closed extremity 30 of the second cylinder 16, and is located at a side of the regenerator 24 opposite to that of the gas inlet 28. In the cooling mode of operation, gas enters and expands in the expansion chamber 26. and so absorbs heat due to the Joule-Thomson effect. The first extremity 30 of the second cylinder 16 is thus cooled.

During gas expansion the displacer 22 is pushed away from the first extremity 30. The displacer 22 is mechanically linked to a pneumatic spring volume 32 located at a second extremity 34 Work is performed as the displacer 22 compresses the pneumatic spring volume 32. The expanded gas from the expansion chamber 26 is then drawn back into the first cylinder 14 after again passing through the regenerator 24.

Means such as an electric motor 36 is provided for driving the piston 12 at a speed required for normal cooling generation. During such operation, the displacer 22 oscillation is less than 90 degrees out of phase with the piston 12 movement.

The above description relates to a known Stirling cooler, and no novelty is claimed therefor.

In the present invention, drive means are provided for selectively driving the piston 12 at a speed above the resonant frequency of the displacer 22. Such drive means in the present embodiment includes a drive belt 38 connecting the electric motor 36 and the piston crankshaft 40. The motor 36 and the crankshaft 40 are both provided with a two-step pulley 42*a*, 42*b*, 44*a*, 44*b*, disposed in opposed formation.

When defrosting of the expansion chamber 26 is required, the belt 38 is re-positioned to convey power, as shown in the figure, from the larger motor pulley 42*a* to the smaller crankshaft pulley 44*b*. Significant piston speed increase results. The higher speed is arranged to cause displacer 22 oscillation to be out of phase with the piston 12 by more than 90 degrees, for the generation of heat in the expansion chamber 26, as will be explained.

When the piston 12 is driven faster than the natural frequency of the oscillating displacer 22, a gas pulse arrives in the expansion chamber 26 already while the displacer 22 is still moving towards the closed end of the chamber. Consequently, the gas, instead of being expanded as when operating in the normal cooling mode, is now compressed by the displacer 22, thereby generating heat in the expansion chamber 26. Thereafter the gas is transferred back to the first cylinder 14 where it arrives in time to be re-expanded. Such expansion absorbs heat which is now obtained from the ambient via the same expanded surface device 20 which in normal operation is used for rejecting heat to the ambient.

Figure 4:
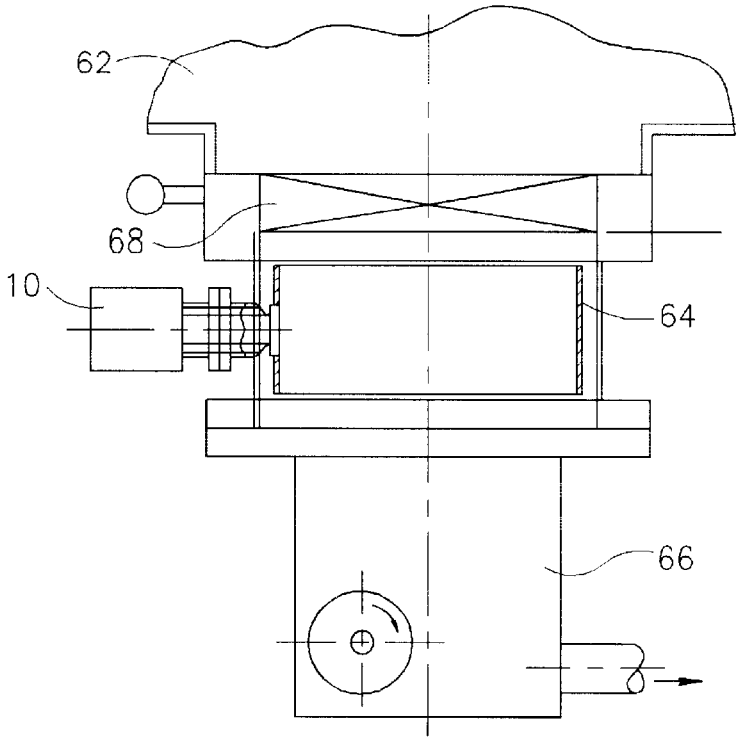
FIG. 4 is a diagrammatic view of a cooled process vacuum chamber according to the invention.

In this way the cold end of the cooler 10 and any items in thermal contact therewith, as seen in FIG. 4, referred to hereinbelow, can be temporarily heated to quickly remove solidified gases attached thereto. In case of a vacuum process, as shown in FIG. 4, these gases are then removed by a suitable high vacuum pump. Thereafter, cooling may be resumed by moving the drive belt 38 to the remaining pair of pulleys 42*b*, 44*a* to drive the piston 12 at its lower speed.

With reference to the rest of the figures, similar reference numerals have been used to identify similar parts.

Figure 2:
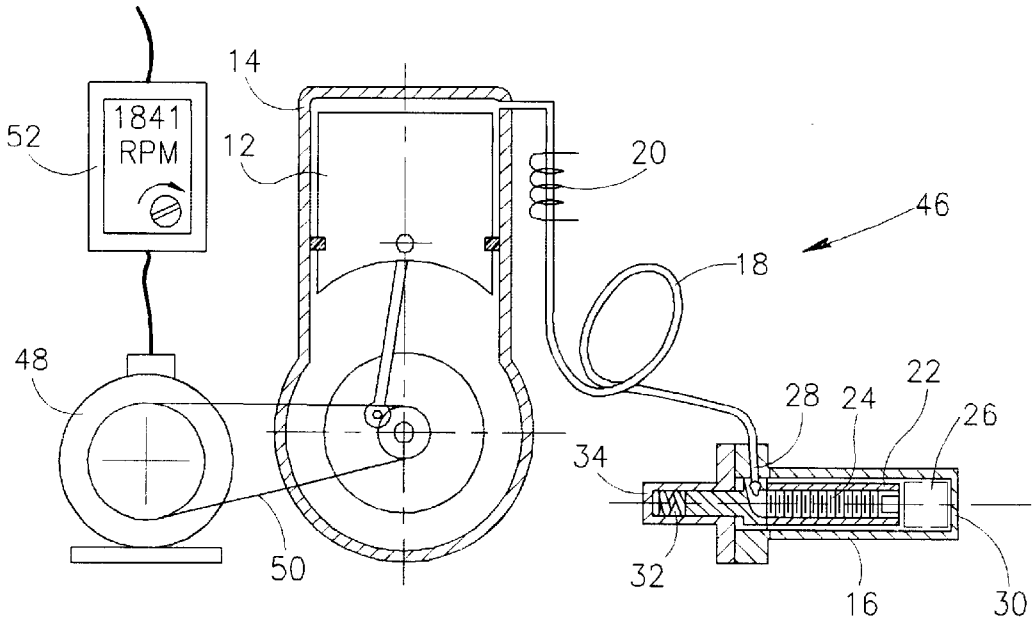
FIG. 2 is a diagrammatic view of an embodiment with electronic speed control.

Referring now to FIG. 2, there is seen a cooler 46 wherein piston drive means comprise a variable speed electric motor 48. The motor 48 is connected to the piston crankshaft by suitable drive means, such as a timing belt 50.

An AC motor is used, and its speed is altered by means of a commercially available controller 52 providing an adjustable frequency drive. A wide range of speeds is available by use of the controller 52, as opposed to the embodiment of FIG. 1 providing only 2 fixed speeds.

Figure 3:
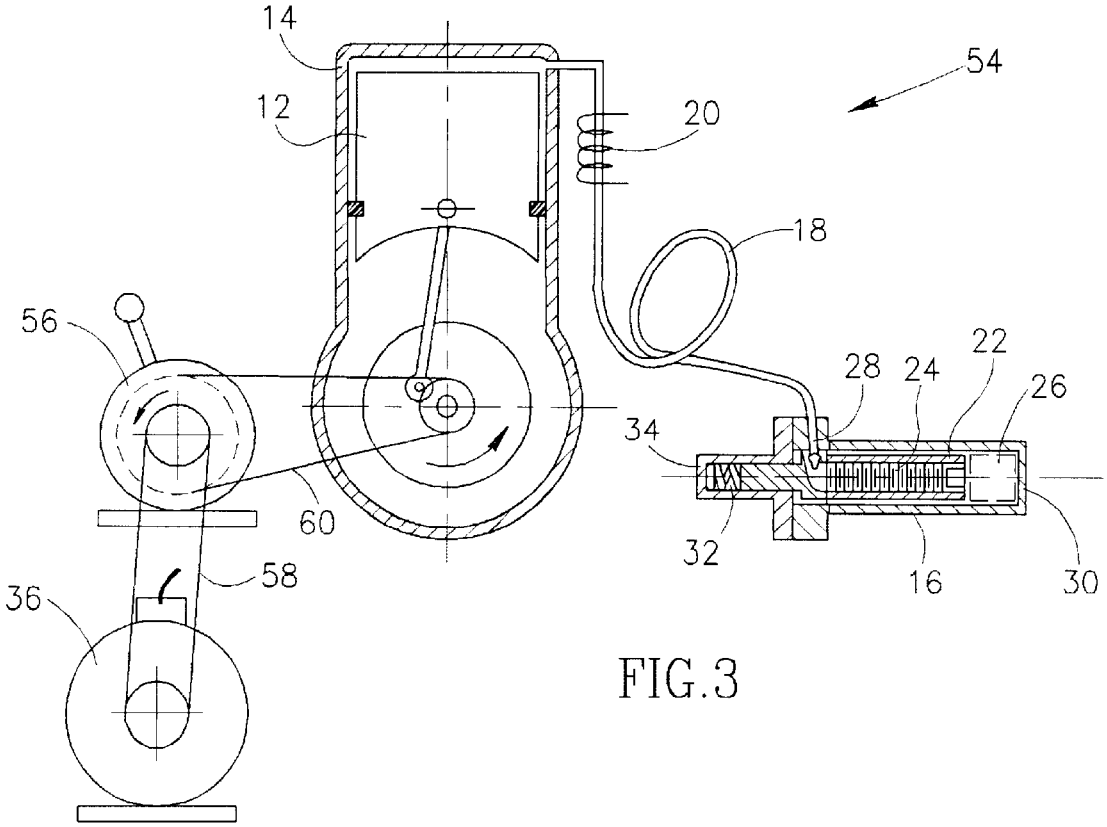
FIG. 3 is a diagrammatic view of an embodiment with mechanical speed control.

FIG. 3 illustrates a further embodiment of the cooler 54. Piston drive means comprise a fixed speed AC electric motor 36 coupled to a variable speed mechanical transmission 56 which drives the piston 12.

Suitably the mechanical transmission 56 is a ball variator, which provides an infinitely variable speed range of up to 9:1. Such variators are available off the shelf. The mechanical transmission is advantageous where electrical disturbances such as are produced by certain electronic motor controllers must be avoided.

It will be noted that the present embodiment uses two belt drives 58, 60. These can be utilized for bringing the speed of the piston 16 to whatever range is required.

Seen in FIG. 4 is a cryogenic vacuum process chamber 62. The chamber 62 can be used for any desired purpose requiring cryogenic cooling, usually in combination with vacuum The chamber 62 is cooled by a panel 64 shown in hollow cylindrical form, which is in thermal contact with a cooler 10 as described with reference to FIG. 1.

A mechanical vacuum pump 66 is in communication with the chamber 62 at a side opposite a gate valve 68.

The chamber 62 is connected to the vacuum source by means of the gate valve 68. Thus when it is necessary to open the process chamber 62 for any purpose, for example the removal of processed work-pieces, (not shown) and inserting the next batch of work-pieces, the gate valve 68 is temporarily closed to prevent excessive vacuum loss, and also to reduce unnecessary contact between atmospheric gases and the panel 64. The valve 68 is reopened for normal operation.

When defrosting of the panel 64 is necessary, the cooler 10 is run at a speed above that of the resonant frequency of displacer 22 to produce heat at the first extremity 30 of the second cylinder 16, as explained with reference to FIG. 1. Obviously supplying such heat to the panel 64 causes much faster defrosting than would be obtained by merely shutting down the cooler 10. Such time saving improves utilization of the process chamber 62 to substantially reduce costs of the work-pieces being processed.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

What is claimed is:

1. A method of operating a stirling cooler, the stirling cooler comprising a driver, a first cylinder including a piston, a second cylinder in fluid communication with said first cylinder through a conduit, said second cylinder comprising:

a displacer adapted for oscillating within said second cylinder;

an expansion chamber in communication with said displacer so as to be cooled by said gas at a first extremity of said second cylinder said expansion chamber at said first extremity of said cylinder;

the method comprising:

driving said piston at a speed such that displacer oscillation is less than 90 degrees out of phase with said piston; and driving said piston at a speed above the resonant frequency of said displacer to cause displacer oscillation to be out of phase with said piston by more than 90 degrees for the generation of heat in said expansion chamber.

2. The method as claimed in claim 1, wherein said driver comprises a variable speed electric motor.

3. The method as claimed in claim 1, wherein said driver comprises a fixed speed electric motor coupled to a variable speed mechanical transmission.

4. The method as claimed in claim 1, wherein said cooler is in thermal contact with a panel, said panel cooling a cryogenic vacuum process chamber, said panel receiving heat from said cooler for defrosting of said panel when said cooler is selectively operated at said speed above said resonant frequency.

* * * * *